US011492235B2

(12) United States Patent
Wehrstedt et al.

(10) Patent No.: US 11,492,235 B2
(45) Date of Patent: Nov. 8, 2022

(54) MEASURING DEVICE FOR LOAD MEASUREMENT IN A HOIST

(71) Applicant: LIEBHERR-WERK EHINGEN GMBH, Ehingen/Donau (DE)

(72) Inventors: Julian Wehrstedt, Ulm (DE); Stefan Windbacher, Ulm (DE); Oliver Ruoss, Ehingen/Donau (DE); Uwe Frommelt, Ehingen/Donau (DE)

(73) Assignee: LIEBHERR-WERK EHINGEN GMBH, Ehingen/Donau (DE)

( * ) Notice: Subject to any disclaimer, the term of this patent is extended or adjusted under 35 U.S.C. 154(b) by 96 days.

(21) Appl. No.: 16/956,507

(22) PCT Filed: Dec. 19, 2018

(86) PCT No.: PCT/EP2018/085956
§ 371 (c)(1),
(2) Date: Jun. 19, 2020

(87) PCT Pub. No.: WO2019/121990
PCT Pub. Date: Jun. 27, 2019

(65) Prior Publication Data

US 2021/0094802 A1 Apr. 1, 2021

(30) Foreign Application Priority Data

Dec. 20, 2017 (DE) ..... 10 2017 130 792.3

(51) Int. Cl.

| | |
|---|---|
| ***B66C 13/16*** | (2006.01) |
| ***B66C 13/08*** | (2006.01) |
| ***B66C 13/46*** | (2006.01) |

(52) U.S. Cl.
CPC ..... *B66C 13/16* (2013.01); *B66C 13/085* (2013.01); *B66C 13/46* (2013.01)

(58) Field of Classification Search
None
See application file for complete search history.

(56) References Cited

U.S. PATENT DOCUMENTS 5,321,637 A * 6/1994 Anderson ..... G01G 19/14 702/174
9,617,696 B1 * 4/2017 Burns ..... E01D 15/124
(Continued)

FOREIGN PATENT DOCUMENTS

DE 1120659 B * 12/1961 ..... B66C 13/16
DE 2523690 A1 12/1976
(Continued)

OTHER PUBLICATIONS

ISA European Patent Office, International Search Report Issued in Application No. PCT/EP2018/085956, dated Mar. 8, 2019, WIPO, 2 pages.

*Primary Examiner* — Charles A Fox
(74) *Attorney, Agent, or Firm* — McCoy Russell LLP

(57) ABSTRACT

A measuring device for load sensing in a lifting-cable-based hoist, in particular a crane, having at least one pulley for deflecting the lifting cable of the hoist, a fastening means in the form of a cable loop, at the end of which the pulley is mounted so as to be rotatable about its roller axis, and at least one measuring element for sensing a force applied to the pulley.

20 Claims, 6 Drawing Sheets

(56) References Cited

U.S. PATENT DOCUMENTS

| | | | | |
|---|---|---|---|---|
| 2014/0109682 | A1* | 4/2014 | Mupdende | B66C 15/00 73/812 |
| 2015/0329333 | A1* | 11/2015 | Fenker | B66C 23/022 212/225 |
| 2016/0031680 | A1* | 2/2016 | Delplace | B66C 13/16 703/7 |

FOREIGN PATENT DOCUMENTS

| | | | |
|---|---|---|---|
| GB | 1207697 | A | 10/1970 |
| GB | 2220498 | A | 1/1990 |

* cited by examiner

MEASURING DEVICE FOR LOAD MEASUREMENT IN A HOIST

CROSS-REFERENCE TO RELATED APPLICATIONS

The present application is a U.S. National Phase of International Patent Application Serial No. PCT/EP2018/085956 entitled "MEASURING DEVICE FOR LOAD MEASUREMENT IN A HOIST," filed on Dec. 19, 2018. International Patent Application Serial No. PCT/EP2018/085956 claims priority to German Patent Application No. 10 2017 130 792.3 filed on Dec. 20, 2017. The entire contents of each of the above-referenced applications are hereby incorporated by reference for all purposes.

TECHNICAL FIELD

The present invention relates to a measuring device for load detection in a hoist rope-based lifting device.

BACKGROUND AND SUMMARY

Due to the progressing degree of automation in lifting devices, in particular in cranes having increasingly more complex crane controls, the exact measurement of the load taken up is becoming more and more important. More precise measurement methods permit an increase in the payloads since permitted payload ranges can be better exploited.

Load weighing with lattice mast cranes has up to now taken place via the measurement of the guying forces by means of a tension load cell. The load is then calculated in the crane control using these forces while taking the boom geometry into account. With telescopic cranes, the hydraulic pressure in the lulling ram is detected and the load is calculated using the crane geometry.

There are systems that measure the pull of the rope of the last rope line of the hoist rope, for example by means of a suitable measurement element that is installed at the anchor point of the hoist rope and, and calculate the load via the reeving. The last rope line extends from the last rope pulley up to the anchor point of the hoist rope. Systems are also known that measure the pull of the rope of the first rope line. The first line of the hoist rope in this observation passes from the hoist winch over the boom head top sheave of the boom system and over a rope pulley at the pulley head up to the rope pulley at the hook block.

Finally, systems are known on the market in which a measuring system is already integrated in the lifting hook.

There is a big problem with the previous solutions in accordance with the prior art in that in a hoist rope system having multiple reeving, the precision of the load measurement can be dependent on the specific positioning of the measuring device at the hoist rope. The optimum position of the measuring device at the hoist rope is, however, dependent on the load movement, for example dependent on whether it is being raised or lowered.

FIGS. 1A, 1B are intended to briefly illustrate this problem with the force distribution with multiple reeving. In the static state, the weight force of the load is spread evenly over all the lines. During the lifting movement, however, the force in the greatest in the first line and decreases as the rope number increases (see FIG. 1A). The situation is exactly reversed on the lowering of the load, i.e. the largest force by amount is present in the last line (see FIG. 1B). The reason for this is the friction in the rope pulleys during the lifting or lowering of the load. In the case of lifting, the rope lines 1 to 4 are additionally strained by the friction in the respective rope pulleys, while in the case of lowering, the rope lines 1 to 4 are relieved by the friction in the respective rope pulleys.

An object of the embodiments described is to discover an improved measuring device that also enables a load measurement in a lifting device that is as exact as possible while taking account of the aforesaid problems. A further objective comprises the desire to be able to retrofit existing equipment with a corresponding measuring device simply and inexpensively.

This object and further advantages are achieved by a measuring device having the features of the embodiments described herein.

A measuring device for load detection in a hoist rope-based lifting device is therefore proposed. A crane is in particular to be seen as a lifting device. The use of the measuring device also with other work machines or construction machinery in which corresponding loads are moved by means of a rope system is, however generally conceivable.

In accordance with the embodiments described, the measuring device comprises a deflection pulley that serves to defect the hoist rope of the lifting device during the load measurement. A fastening means is furthermore provided at whose end the deflection pulley is supported rotatably about its pulley axis. The measuring device can be particularly simply installed, in particular suspended, at the existing machine structure by means of the fastening means. This permits a simple retrofitting of existing lifting devices with the measuring device in accordance with the embodiments described. In addition, the exact positioning of the measuring device at the lifting device can be changed particularly simply and fast in order, for example, to be able to utilize the respective optimum position for the kind of load movement.

Only the extent of the hoist rope has to be modified such that it runs over the deflection pulley of the hoist rope for the installation of the measuring device at the existing structure of the lifting device. The deflection pulley can here either replace an existing pulley of the lifting device or can be integrated as an additional deflection pulley in the extent of the hoist rope.

At least one measuring element is furthermore provided that detects the forces applied to the deflection pulley and enables a load measurement based thereon.

A loop body has proven to be particularly advantageous as a fastening means, ideally in the form of a rope loop. The installation of the measuring device is hereby not only greatly simplified, but also proves to be extremely flexible since corresponding complementary connection means are not absolutely necessary at the structure of the lifting device.

In accordance with preferred embodiments, the measuring device is suspended at an existing pulley, in particular a deflection pulley of the hoist device by means of the loop body, i.e. the loop body is placed around the running surface of an existing pulley. The measuring device is accordingly installed suspended at the pulley, which has the advantage that it can always align itself in the direction of the load.

A rope loop that is ideally formed from a plastic rope is particularly suitable. The greater flexibility and pliancy of the plastic rope not only facilitates the installation process, but the lift height loss can thereby also be kept as low as possible. The total weight of the measuring device can furthermore naturally also thereby be reduced.

Various measurement sensors can be used as the measuring element. Reference is made here by way of example to hanging scales and/or to a plug gauge, and/or to a measuring ring. The measuring element can either be completely formed by one of these elements or can comprise one of these elements.

The fastening of the measuring element preferably takes place via at least one connection means at the deflection pulley of the measuring device or at the fastening means, in particular at a loop body of the measuring device. The use of a rocker arm by which the measuring element is fastened to the loop body of the measuring device is sensible here.

The suspension of the measuring device at an existing deflection pulley of the lifting device by means of the loop body has the advantage that the measuring device is thereby automatically aligned in the direction of the load. It can occur in certain crane applications or lifting work that the load is deflected with respect to the perpendicular. A lifting operation using two lifting hooks or to hoist winches can be named as an example here. It is sensible in this case to equip the measuring device with an additional positional sensor, in particular an angle transmitter, so that the orientation of the measuring device with respect to the perpendicular can be taken into account in the measurement and in the subsequent evaluation of the measurement signals.

For example, the torque applied to the lifting device can be detected and corrected using these measurement data.

Provision is sensibly made for the provision of the measurement data that the measuring device is equipped with at least one communication module for transmitting the measurement data to an external reception unit. The transmission of the measurement data to a possible machine control of the lifting device is conceivable here. The communication module can be suitable either for wired or wireless data transmission. A communication module is naturally also possible that supports both transmission techniques.

With a wired transmission, the measuring device provides one or more connection points for the connection of possible communication lines at the hardware side. In the case of a wireless communication method, the communication module comprises one or more antennas for the data transmission on the basis of one or more transmission standards.

The measuring device furthermore provided a corresponding interface for the energy supply for connection to a possible supply line. The integration of at least one internal energy source in the measuring device is also conceivable; for example a rechargeable battery or a replaceable energy source.

In addition to the measuring device in accordance with the embodiments described, a lifting device, in particular a crane having at least one measuring device in accordance with some embodiments is likewise described. The lifting device in accordance with the embodiments described may be accordingly characterized by the same advantages and properties such as were already presented above with reference to the lifting device. A repeat description is dispensed with for this reason.

Provision can furthermore be made that the measuring device is suspended at at least one pulley of the lifting device by means of the fastening means, in particular the loop body, with the hoist rope of the lifting device being deflected by means of the at least one deflection pulley of the measuring device. As has already been noted above, the deflection pulley of the measuring device can here replace an existing deflection pulley of the lifting device or can be additionally integrated in the extent of the rope. It is particularly advantageous if the measuring device is arranged at a deflection pulley of the pulley head of the lifting device. In the case of multiple reeving of the rope extent of the hoist rope, it is particularly preferred if the measuring device is suspended at a center deflection pulley of the reeving. The removal of the degree of action by calculation is not necessary in this case.

It is equally of advantage if the lifting device has a plurality of load measuring devices, with at least one of these load measuring devices being configured in accordance with the measuring device in accordance with the embodiments described.

With multiple rope reeving, it is particular advantageous if a measuring device is arranged at the front in the reeving, whereas at least one second measuring device is attached to the end of the reeving. The problem of the degree of action described in the introductory part is hereby eliminated.

The at least two measuring devices are advantageously designed in accordance with the measuring device in accordance with the embodiments described; however, at least one of the installed measuring devices can also be fixedly integrated in the rope in the form of a conventional load cell or tension load cell.

In an alternative embodiment, the lifting device in accordance with the embodiments described works with a parallel hoist rope operation, i.e. the lifting device comprises more than one hoist rope optionally each having a separate hoist winch. It is sensible in this connection if every hoist rope is designed with at least one measuring device, in particular a measuring device in accordance with the measuring device in accordance with the embodiments described.

It is desirable for the following data evaluation or for the exact load determination if the measuring device communicates with the machine control of the lifting device via a wired or also wireless connection. In accordance with a preferred embodiment, the final evaluation of the measurement data only takes place in the machine control, i.e. the exact load calculation is carried out by the machine control. Alternatively, however, there is the possibility of transposing the load calculation into the measuring device itself.

It is moreover conceivable that the measuring device is supplied with electrical energy by means of an energy source of the lifting device over corresponding supply lines. The energy supply is particularly simple on an arrangement of the measuring device in the region of the pulley head of the lifting device since the measuring device is then positioned in the direct vicinity of the machine structure. The same applies to the communication between the lifting device and the measuring device since use can be made without problem of a wired communication connection. Wireless connections are in particular often susceptible to interference in lifting devices comprising sheet metal or with a steel structure.

The arrangement of the measuring device at the pulley head or directly at the structure of the lifting device is generally preferred. There is, however, equally the possibility of deploying the measuring device in accordance with the invention in the reeving of the hook block. However, in this connection, a sufficient performance level and also an alternative energy supply would have to be found for the communication with the machine control.

The machine control of the lifting device is advantageously suitable to determine the weight of the load taken up using the forces measured by means of the measuring device and while taking account of the hoist rope extent. Optionally, possible structural parameters of the lifting device can enter into the calculation. The number of rope lines is in particular taken into account on the consideration of the rope extent with multiple reeving. If the measuring device is optionally equipped with a corresponding positional sensor, in particular an angle sensor, these measurement values can also be used for the load calculation by the machine control.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

The accompanying drawings are incorporated herein as part of the specification. The drawings described herein illustrate embodiments of the presently disclosed subject matter, and are illustrative of selected principles and teachings of the present disclosure. However, the drawings do not illustrate all possible implementations of the presently disclosed subject matter, and are not intended to limit the scope of the present disclosure in any way. Further advantages and properties of the invention will be explained in more detail in the following with reference to embodiments shown in more detail in the drawings, wherein.

DETAILED DESCRIPTION

Figure 1A:
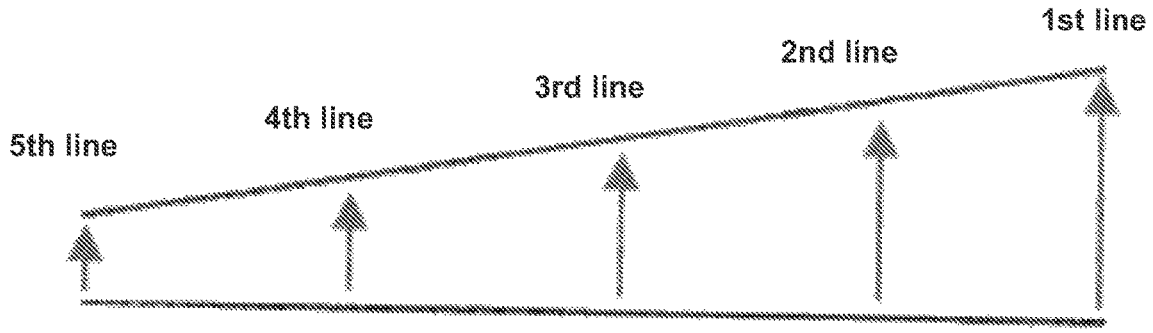
FIGS. 1A and 1B provide schematic representations of the force distribution in the individual rope lines during the lifting or lowering process.
Figure 1B:
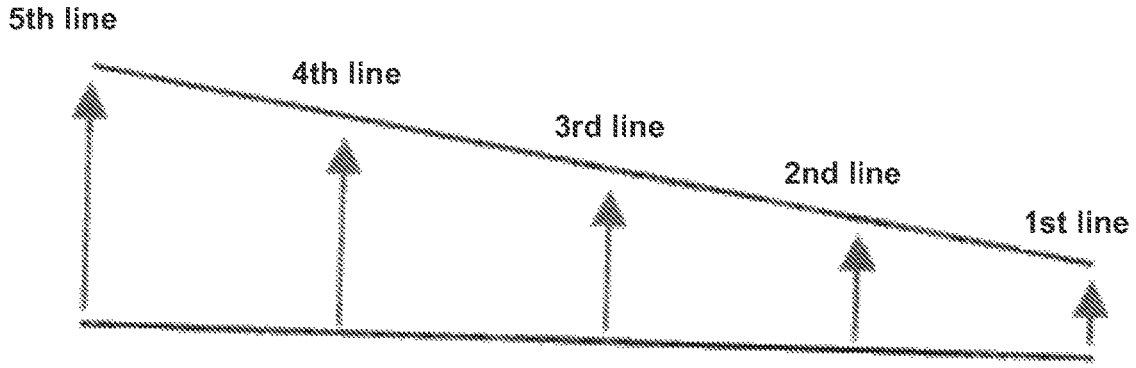

It is to be understood that the invention may assume various alternative orientations and step sequences, except where expressly specified to the contrary. It is also to be understood that the specific assemblies and systems illustrated in the attached drawings, and described in the following specification are simply exemplary embodiments of the inventive concepts defined herein. Hence, specific dimensions, directions or other physical characteristics relating to the embodiments disclosed are not to be considered as limiting, unless expressly stated otherwise. Also, although they may not be, like elements in various embodiments described herein may be commonly referred to with like reference numerals within this section of the application.

Figure 2:
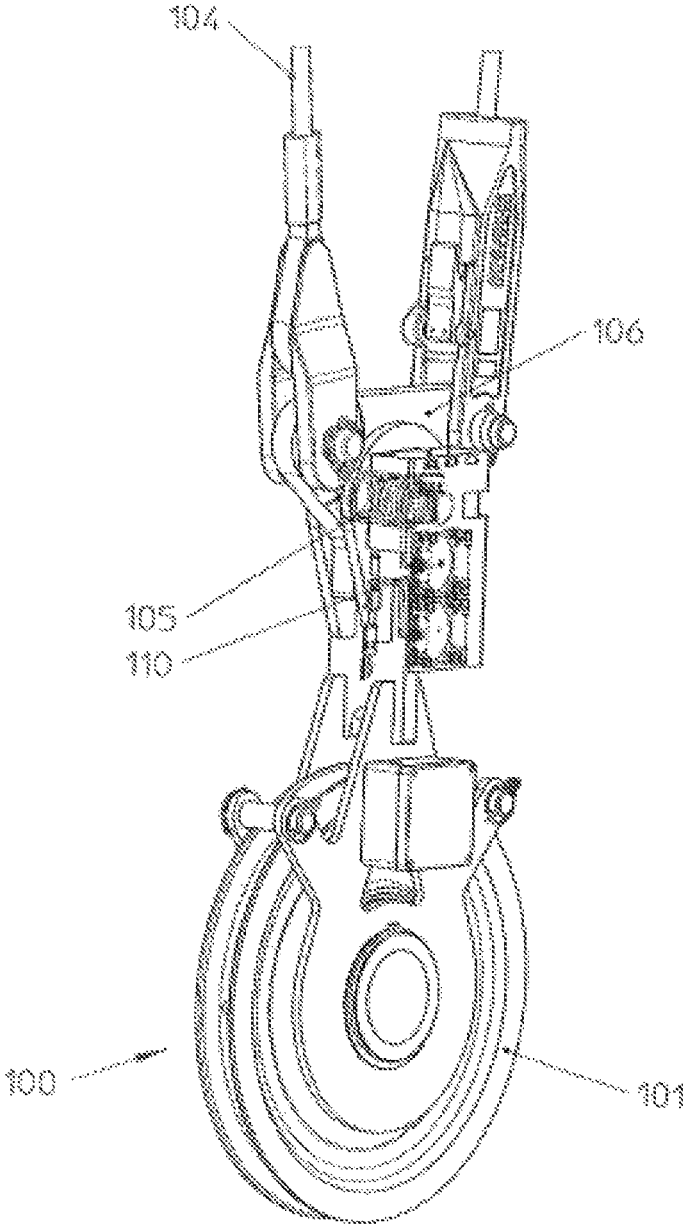
FIG. 2 is a perspective side view of the measuring device in accordance with the embodiments described.
Figure 3:
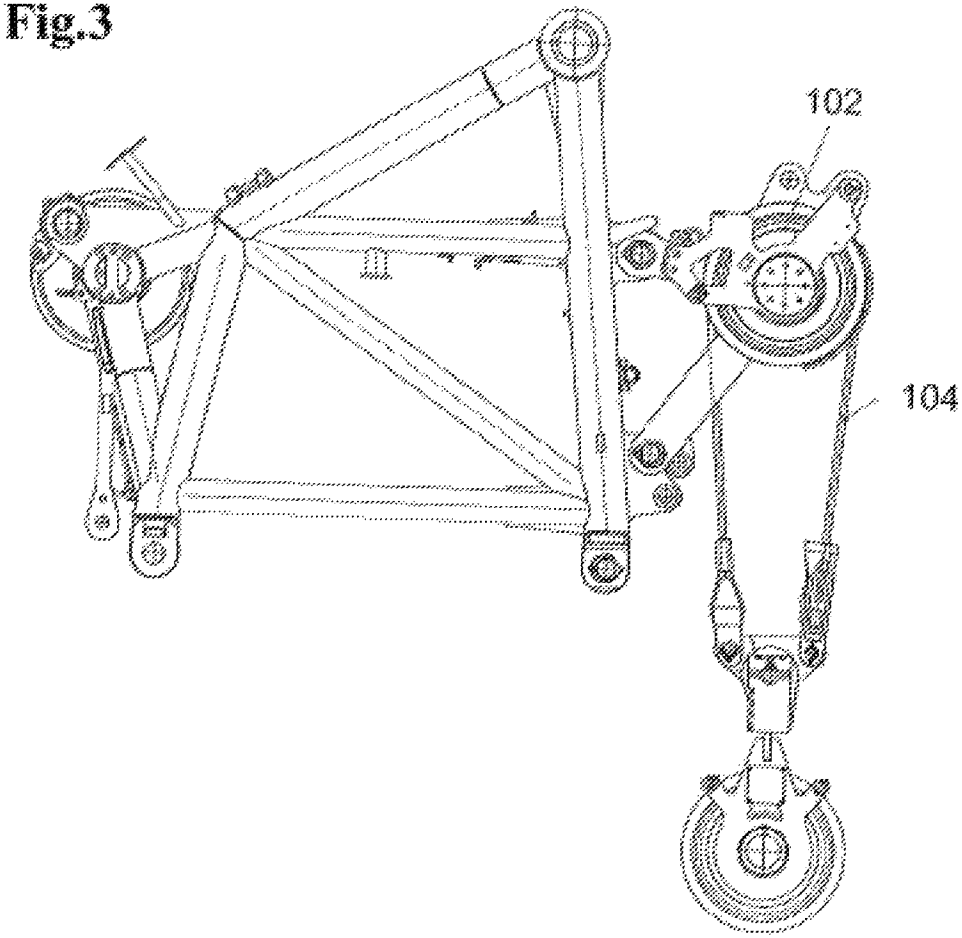
FIG. 3 is a detailed representation of the pulley head without a fly boom of a crane in accordance with the embodiments described with a measuring device installed.

The measuring device 100 in accordance with the invention can be seen in detail from FIG. 2. It comprises a deflection pulley 101 that is adapted to deflect the hoist rope 4 of the crane in place of a deflection pulley attached in the pulley head 102 of the crane in accordance with the invention (FIG. 3). It is thereby possible to use the measuring device at any position in the reeving.

Figure 4:
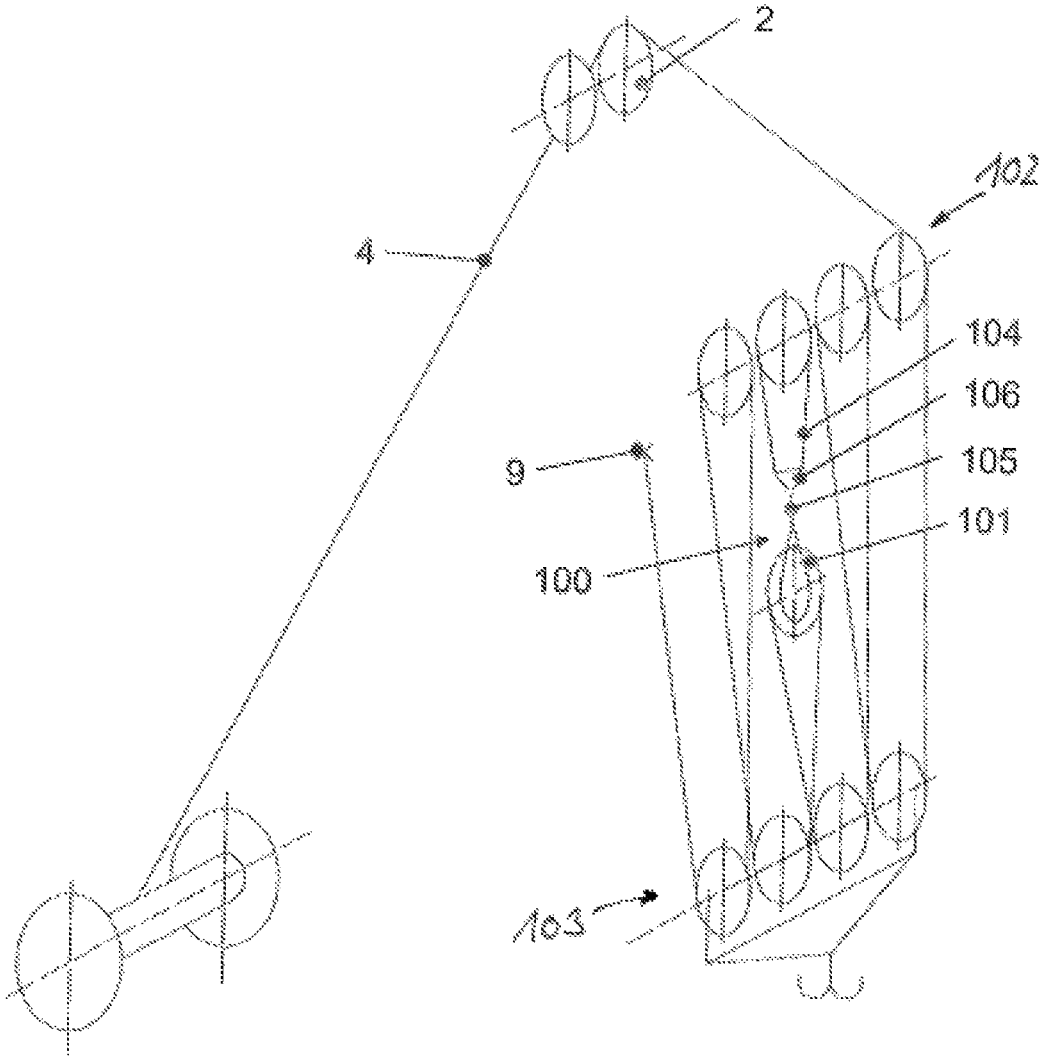
FIG. 4 is a sketched representation of the rope extent of the crane in accordance with the embodiments described with a measuring device installed.

The schematic rope extent of the hoist rope 4 with an installed measuring device 100 can be easily recognized in FIG. 4, for example. The hoist rope 4 here extends from the hoist winch to the boom tip where it is led over the boom head top sheave 2 to the pulley head 102. A multiple reeving of the hoist rope 4 is present between the pulley head 102 and the hook block and provides four respective deflection pulleys at the pulley head 102 and in the region of the hook block. In the embodiment of FIG. 4 shown, the penultimate deflection pulley of the pulley head 102 is, for example, taken out of the rope extent and instead serves as a suspension means for the measuring device 100 in accordance with the invention. The hoist rope 4 instead extends over the integrated deflection pulley 101 of the measuring device 100 back to the hook block. Detailed representations of the boom tip can be seen from FIGS. 3 and 5.

The fastening of the measuring device 100 to the deflection pulley of the pulley head 102 is achieved by a rope loop 104 that is placed around the deflection pulley of the pulley head 102. The rope loop is preferably formed by a plastic rope. The two loop ends are connected to the measuring device 100 via a rocker arm 106. It is ensured by the flexible suspension of the measuring device 100 by means of the rope loop 104 that the measuring device is automatically aligned in the direction of the load taken up.

The deflection pulley 101 and the associated pulley support are connected to the rocker arm 106 via a measuring element 105 so that the force applied by the hoist rope 4 to the deflection pulley 101 can be detected by the measuring element 105. It can, for example, be designed as hanging scales, a plug gauge or as a measuring ring. In the embodiment of Figure shown, a plug gauge is specifically used.

Figure 5:
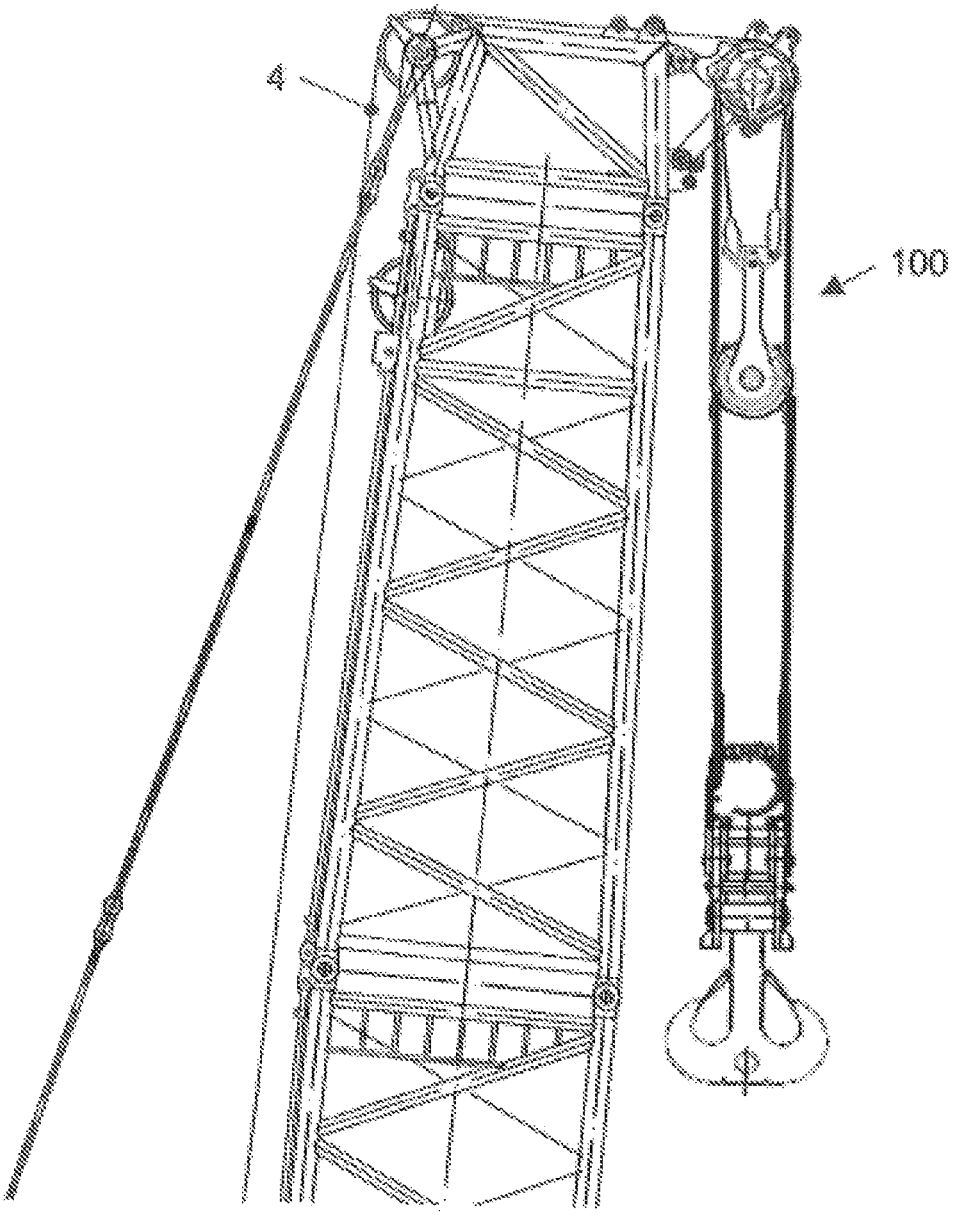
FIG. 5 is an enlarged representation of the boom tip without a fly boom of a crane in accordance with the embodiments described with a measuring device installed.
Figure 6:
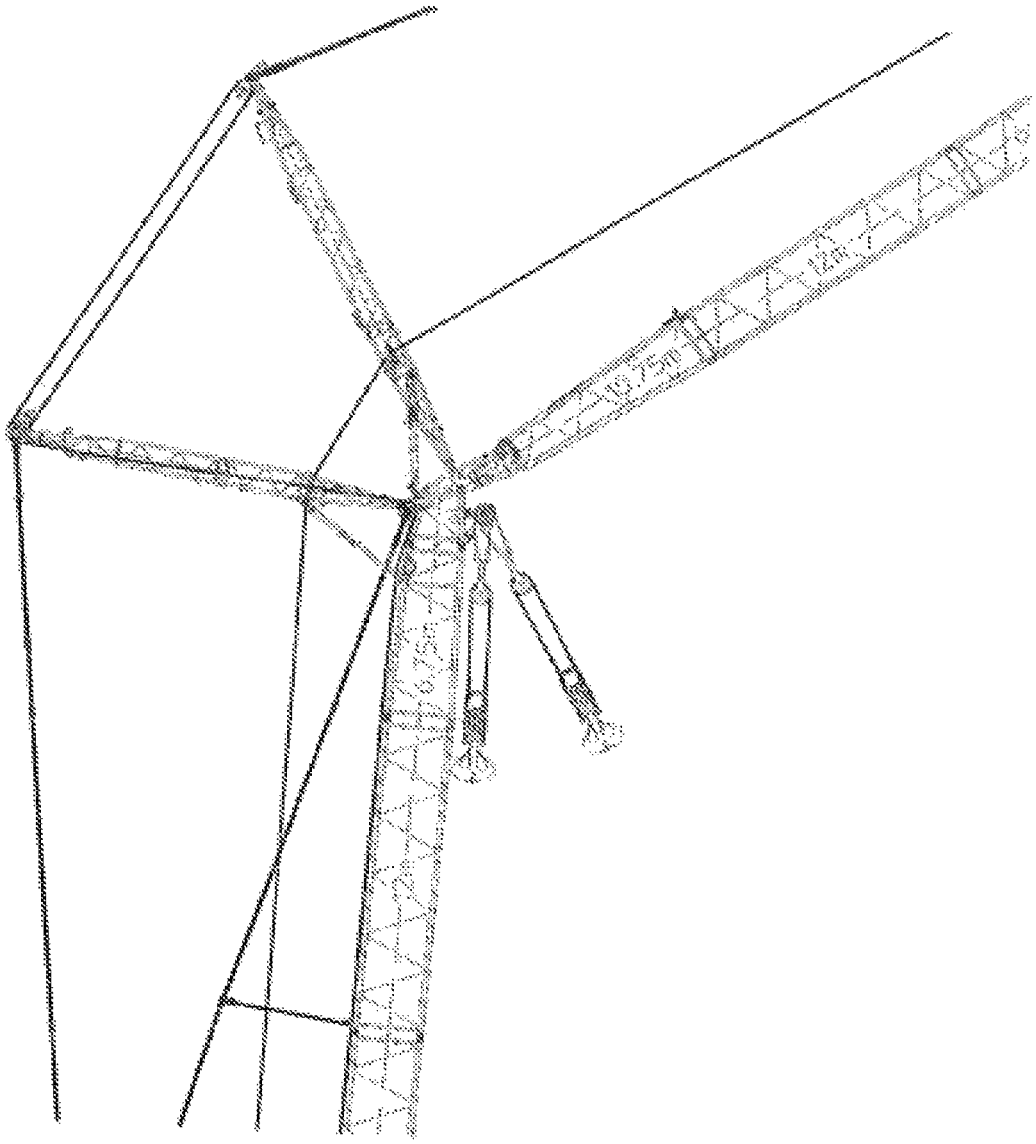
FIG. 6 is a further embodiment of the crane in accordance with the invention with two representations of a lifting hook, at the left without diagonal pull and at the right with diagonal pull.

To eliminate the above-named problem of the degree of action, a second measuring device, that is likewise introduced into the pulley head 102, can be used in addition to the measuring device 100 shown in FIGS. 3-5. It is meaningful in such a case to integrate one measuring device 100 as far to the front as possible in the reeving and to integrate a further measuring device 100 as far to the back as possible in the reeving. The second measuring device could also be designed in the form of a conventional measuring device, for example by a simple load cell or a plug gauge in the region of the rope anchor point 9.

The transmission of the measurement data takes place via a wired connection to the crane control. The energy supply of the measuring device 100 also takes place from a central energy source of the crane via supply lines. The at least one measuring device 100 delivers its data to the crane control. Optionally, an additional convention tension load cell delivers its data to the crane control. The crane control then calculates the weight of the load using the known number of rope lines between the pulley head 102 and the hook block 103 and the measured forces. In the simplest case, a linear relationship can be assumed.

FIG. 5 shows an embodiment of the crane with two lifting hooks and two winches (2-hook operation). Only one hoist rope 4 that is located at the pivot point of the horizontal luffable boom at the crane tower top is drawn in the representation. It may occur due to the parallel operation of a plurality of hoist ropes that the lifting hook is moved from a perpendicularly aligned location into a pivoted position relative thereto. It is, however, necessary in this connection that that the specific alignment of the lifting hook is considered in the calculation of the load taken up. It is sensible in this case if an angle transmitter 110 is additionally integrated in the measuring device 100. The deflection of the load with respect to the perpendicular can thus be determined and likewise transmitted to the crane control. The torque applied to the crane can hereby be detected and corrected by means of these data. The advantages of the measuring device 100 in accordance with the embodiments described or of the crane in accordance with the embodiments described can be summarized briefly again in the following.

The solution in accordance with the embodiments described in the form of the measuring device 100 enables a particularly simple retrofitting of existing cranes or lifting devices since they can be particularly simply attached to existing rope pulleys of the crane or of the lifting device. In the embodiments described, the measurement of the hook load takes place via the pull of the rope of the hoist rope 4. Due to the line number only one measuring element 105 is required for relatively low forces and a scaling takes place automatically over the reeving. The solution in accordance with the embodiments described can be advantageously used in an operation with two hoist ropes and two winches. A respective measuring device 100 is here present in both hoist rope lines. The force in each of the hoist ropes is thus known and it is possible for the control to maintain the force as approximately the same in both hoist ropes by correcting the winch drive. An improper tilt of the bottom hook block is thus prevented.

A further advantage of the embodiments described comprises the number of rope deflections remaining the same on an integration of the measuring device 100, whereby the hoist rope 4 is not subject to any greater wear. A signal transmission over a longer distance, for example by means of radio, is also not necessary since the measuring device 100 is always attached to the boom head 102, even if the rope anchor point is at the bottom hook block. Due to the relatively low forces, standard measuring elements 105 can be used, whereby the measuring unit is very inexpensive. The total weight, including the bottom hook block 103 and any additional weights, suspended at the pulley head 10 can be detected by the measuring device 100

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

It will be appreciated that the configurations and routines disclosed herein are exemplary in nature, and that these specific embodiments are not to be considered in a limiting sense, because numerous variations are possible. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, are also regarded as included within the subject matter of the present disclosure.

The invention claimed is:

1. A measuring device for load measurement in a hoist rope-based lifting device or a crane, the measuring device having at least one deflection pulley for deflecting the hoist rope of the lifting device positioned in a multiple reeving of the hoist rope between a pulley head and a reeving pulley of a hook block, a fastening means at whose end the deflection pulley is supported rotatably about its pulley axis, and at least one measuring element for detecting a force applied to the deflection pulley, wherein the hoist rope extends over a lifting device boom top sheave to the multiple reeving and a lifting hook of the hook block.

2. The measuring device in accordance with claim 1, wherein the fastening means is a loop body, a rope loop, or a plastic rope loop.

3. The measuring device in accordance with claim 1, wherein the measuring element comprises hanging scales or a plug gauge or a measuring ring.

4. The measuring device in accordance with claim 1, wherein the measuring element is connected to the fastening means, the fastening means comprising a loop body, by means of at least one connection means, the at least one connection means comprising a rocker arm.

5. The measuring device in accordance with claim 1, wherein the measuring device comprises at least one positional sensor, the at least one positional sensor comprising an angle transmitter.

6. The measuring device in accordance with claim 1, wherein the measuring device comprises at least one communication module adapted for transmitting measurement data to a reception unit, wherein the at least one communication module is adapted for wired and/or wireless communication.

7. A lifting device having at least one measuring device in accordance with claim 1, the at least one measuring device comprising a first measuring device.

8. The lifting device in accordance with claim 7, wherein the first measuring device is suspended at at least one pulley of the lifting device by means of the fastening means, the fastening means comprising a loop body, and wherein the hoist rope of the lifting device is deflected by means of the at least one deflection pulley of the first measuring device.

9. The lifting device in accordance with claim 8, wherein the first measuring device is suspended by means of the loop body at at least one deflection pulley of the pulley head of a boom system, with a centrally disposed deflection pulley serving to suspend the first measuring device in the pulley head.

10. The lifting device in accordance with claim 9, wherein a second measurement device is provided at the lifting device.

11. The lifting device in accordance with claim 10, wherein the second measuring device is fastened in a region of the hoist rope different from the first measuring device, and wherein one of the measuring devices is particularly preferably arranged at a start of a multiple reeving of the pulley head, while another measuring device is installed at an end of the multiple reeving.

12. The lifting device in accordance with claim 10, wherein the lifting device comprises at least two hoist ropes, and wherein at least one measuring device in accordance with claim 1 is provided per hoist rope.

13. The lifting device in accordance with claim 7, wherein the first measuring device communicates with a machine control of the lifting device via wired communication and/or is supplied with electrical energy by a line via an energy source of the lifting device.

14. The lifting device in accordance with claim 7, wherein the first measuring device is arranged at the hook block.

15. The lifting device in accordance with claim 7, wherein the first measuring device communicates with a machine control of the lifting device, and wherein the machine control is adapted to calculate a weight of a load taken up using forces measured by means of the first measuring device and taking into account the number of rope lines with multiple reeving.

16. A method of load measurement comprising:

providing a measuring device for load measurement in a hoist rope-based lifting device, the measuring device having at least one deflection pulley positioned in a multiple reeving of the hoist rope between a pulley head and a reeving pulley of a hook block, a fastening means at whose end the deflection pulley is supported rotatably about its pulley axis, and at least one measuring element, wherein the hoist rope extends over a lifting device boom top sheave to the multiple reeving and a lifting hook of the hook block;

deflecting the hoist rope of the lifting device using the at least one deflection pulley; and detecting a force applied to the deflection pulley using the at least one measuring element.

17. The method of claim 16, wherein the fastening means is a loop body, a rope loop, or a plastic rope loop, and wherein the measuring element comprises hanging scales or a plug gauge or a measuring ring.

18. The method of claim 16, wherein the measuring element is connected to the fastening means, the fastening means comprising a loop body, by means of at least one connection means, the at least one connection means comprising a rocker arm.

19. The method of claim 16, wherein the measuring device comprises at least one positional sensor, the at least one positional sensor comprising an angle transmitter.

20. The method of claim 16, wherein the measuring device comprises at least one communication module, and the method further comprises transmitting measurement data to a reception unit using the at least one communication module, wherein the at least one communication module is adapted for wired and/or wireless communication.

* * * * *